US006200180B1

(12) United States Patent
Hooper

(10) Patent No.: US 6,200,180 B1
(45) Date of Patent: Mar. 13, 2001

(54) MOORING SYSTEM FOR TANKER VESSELS

(75) Inventor: Alan G. Hooper, Singapore (SG)

(73) Assignee: Nortrans Offshore (S) Pte Ltd (SN)

( * ) Notice: Subject to any disclaimer, the term of this patent is extended or adjusted under 35 U.S.C. 154(b) by 0 days.

(21) Appl. No.: 09/145,023

(22) Filed: Sep. 1, 1998

(51) Int. Cl.[7] ..... B63B 22/02

(52) U.S. Cl. ..... 441/5; 114/230; 114/293; 405/169

(58) Field of Search ..... 114/230, 293; 441/3–5; 405/169–171

(56) References Cited

U.S. PATENT DOCUMENTS

| | | | | |
|---|---|---|---|---|
| 5,002,433 | | 3/1991 | Paasche et al. . | |
| 5,025,742 | | 6/1991 | Urdshals . | |
| 5,113,778 | | 5/1992 | Paasche et al. . | |
| 5,237,948 | | 8/1993 | Hvide . | |
| 5,515,804 | * | 5/1996 | Pollack | 441/5 |
| 5,564,957 | * | 10/1996 | brevik et al. | 441/5 |
| 5,944,448 | * | 8/1999 | williams | 441/3 |

FOREIGN PATENT DOCUMENTS

| | | |
|---|---|---|
| 0 399 719 | 2/1993 | (EP) . |
| 2296904 | 7/1996 | (GB) . |

* cited by examiner

*Primary Examiner*—Jesus D. Sotelo
(74) *Attorney, Agent, or Firm*—Jones, Tullar & Cooper

(57) ABSTRACT

A mooring system for a Floating Production, Storage and Offloading vessel (FPSO) employs a vessel mounted rotatable turret and a single point mooring arrangement. The mooring arrangement includes a single anchor chain that is removably attached at a top end to the vessel, and is attached at a submerged bottom end to three sealed anchored leg chains. The anchor chain is secured to the vessel by means of a chain stopper that is centrally located in the rotatable turret, and allows the vessel to rotate freely about the anchor chain's vertical axis. One or more submerged fluid carrying risers are detachably connected to a swivel stack positioned above the mooring table in line with the rotational axis of the anchor chain so that the risers and the anchor chain will not become entangled with one another during vessel rotation. In one embodiment, the swivel stack and a pulley sheave for retrieving the anchor chain are mounted on a movable frame that facilitates quick and easy connection/disconnection of the chain and risers. In a second embodiment, the pulley sheave is disposed on a frame that is pivotally mounted to the vessel so that it can be rotated between a first position for retrieving the anchor chain, and a second position that enables free rotation of the mooring table and a swivel stack support attached thereto.

19 Claims, 6 Drawing Sheets

MOORING SYSTEM FOR TANKER VESSELS

BACKGROUND OF THE INVENTION

The present invention relates to a mooring system for tanker vessels that employs a vessel mounted turret in combination with a single anchor chain, three leg mooring arrangement to automatically accommodate movement of the vessel due to environmental forces, provide a removable connection to a subsea oil riser, and be easily adapted to varying water depths.

FPSOs are Floating Production, Storage and Offloading vessels which are employed to temporarily store oil received from offshore subsea and dry surface wells (or in the case of an FSO, pumped from offshore production facilities) until an oil tanker anives to receive the oil from the FPSO. Typically, an FPSO is itself an oil tanker that has been modified to receive the oil directly from one or more subsea risers (flexible pipelines), and be moored in a fixed position near the offshore oil wellheads or production facilities. The mooring systems employed to hold the FPSOs in place must be specially designed for a number of reasons. In particular, the mooring system must not interfere with one or more subsea oil risers that are employed to transfer oil from the offshore production facility to the FPSO. Additionally, the mooring system must be designed to withstand adverse environmental conditions, including rough seas and strong winds, since offshore production facilities are typically located in areas subject to such conditions.

The foregoing requirements have resulted in the design of a number of different mooring arrangements for FPSOs. The most popular design is known as a single point mooring system in which only the bow (or stern) of the FPSO is attached to the mooring, thus allowing the FPSO to pivot or "weathervane" about a single axis of rotation in response to wind or water currents. The most popular of the single point mooring systems is the turret mooring system. Previous turret mooring systems have consisted of a number of mooring lines that are attached to a rotatable turret. The risers enter the rotatable turret centrally inside a turret chain attachment-point radius. The turret mooring may be attached to the sea bed by 5 to 20 mooring lines in a radial or clustered pattern. A number of these turret mooring systems have been built so that they can be disconnected before severe storms approach. The turret mooring is then dropped or lowered into the sea from the FPSO while the turret turntable is still attached to the risers and the anchor chains. These systems are complex and expensive to build, and they are not built for multiple relocations at low cost. The weathervaning action also presents problems if the water and/or wind currents are such that the FPSO pivots more than 360 degrees about its starting position, thereby twisting the oil riser(s) and the mooring chains. Hence, the turret moorings are made such that they can rotate around a single point of rotation on bearings.

SUMMARY OF THE INVENTION

The present invention addresses the foregoing concerns through provision of a mooring system that employs a vessel mounted turret in combination with a single anchor chain, three leg mooring arrangement. The turret includes a mooring table which is mounted to the vessel by means of bearings that allow the table to rotate relative to the vessel. A chain stopper and a riser guide are provided on the mooring table for holding the anchor chain and the risers in a spaced relationship to one another. The single anchor chain simplifies the arrangement in this regard, and is connected a number of meters below the vessel to a group of three mooring leg chains, each of which is anchored to the seabed.

Mounted above the mooring table is a swivel stack comprising a plurality of swivel joints that are associated with water injection, well effluent and gas injection risers. A quick connect/disconnect connection is also provided to facilitate easy connection and disconnection of the swivel stack to and from the riser without having to disconnect the mooring table.

In a first embodiment of the invention, the swivel stack and a pulley sheave for an anchor chain pull-in line are both mounted on a movable frame to assist the mooring connection/disconnection process. More particularly, the frame is movable to a first position in which the pulley sheave is positioned directly over the chain stopper to allow the pull-in line and anchor chain to be retrieved from the water by a vessel mounted winch, and secured to the chain stopper. The frame is then moved to a second position in which the swivel stack is positioned in line with the mooring table's rotational axis, and an elbow pipe is in an engagement position with the quick connect/disconnect connection. In this manner, the movable frame facilitates quick and easy connection and disconnection of the anchor chain and risers to and from the vessel. In a second embodiment of the invention, a frame for the pulley sheave is mounted on a pivot which enables the sheave frame to rotate about a vertical axis between a first and second positions. In the first position, the pulley sheave is directly over the chain stopper as in the first embodiment to allow the pull-in line and anchor chain to be retrieved, while in the second position, the sheave frame is rotated clear of the mooring table so that the table and swivel stack can rotate freely without interference from the sheave frame.

BRIEF DESCRIPTION OF THE DRAWINGS

The features and advantages of the invention will become apparent from the following detailed description of a preferred embodiment thereof, taken in conjunction with the accompanying drawings, in which.

DETAILED DESCRIPTION OF THE PREFERRED EMBODIMENTS

Figure 1:
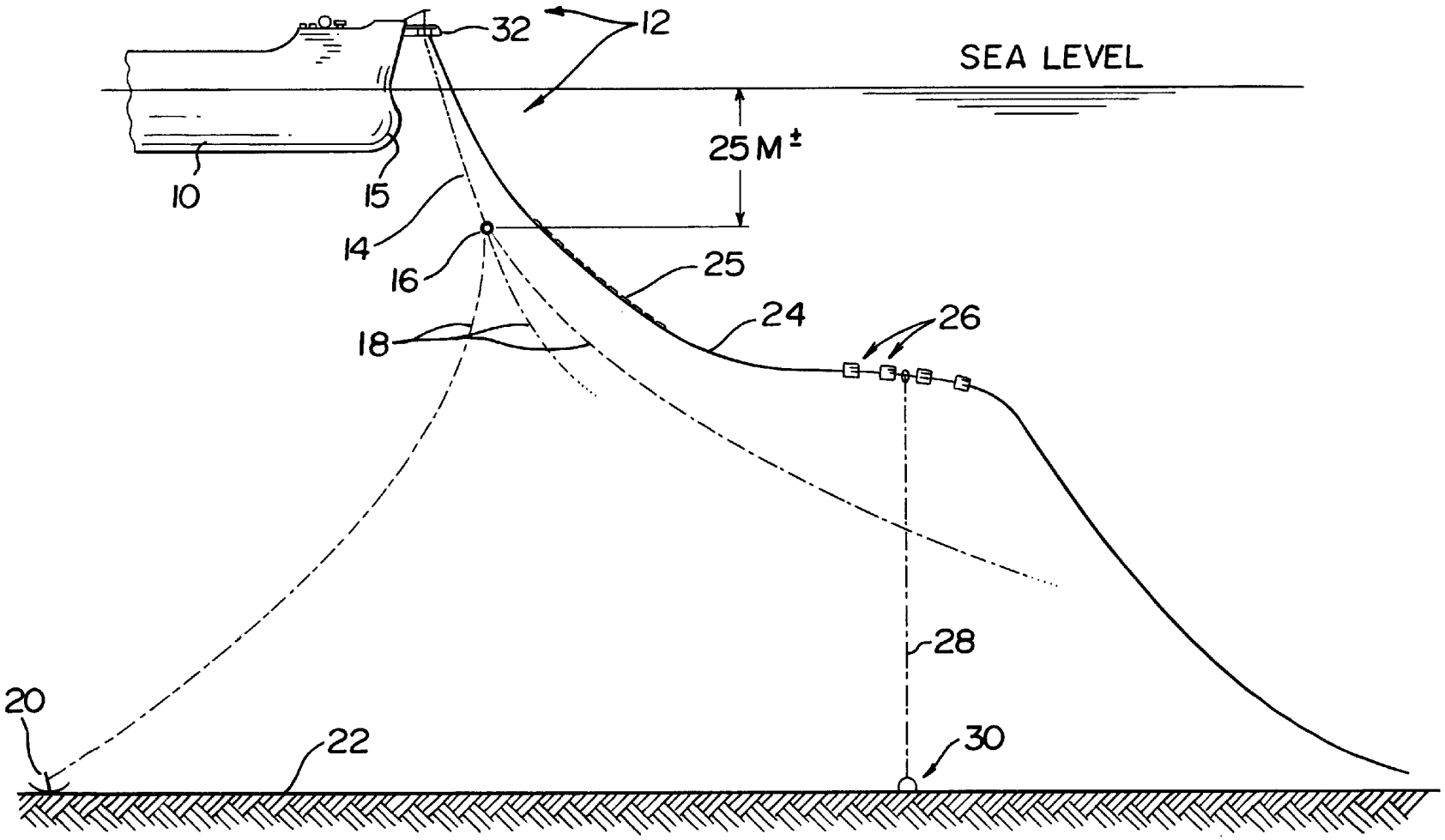
FIG. 1 is a diagrammatic illustration of a mooring system constructed in accordance with the preferred embodiments of the present invention.
Figure 2:
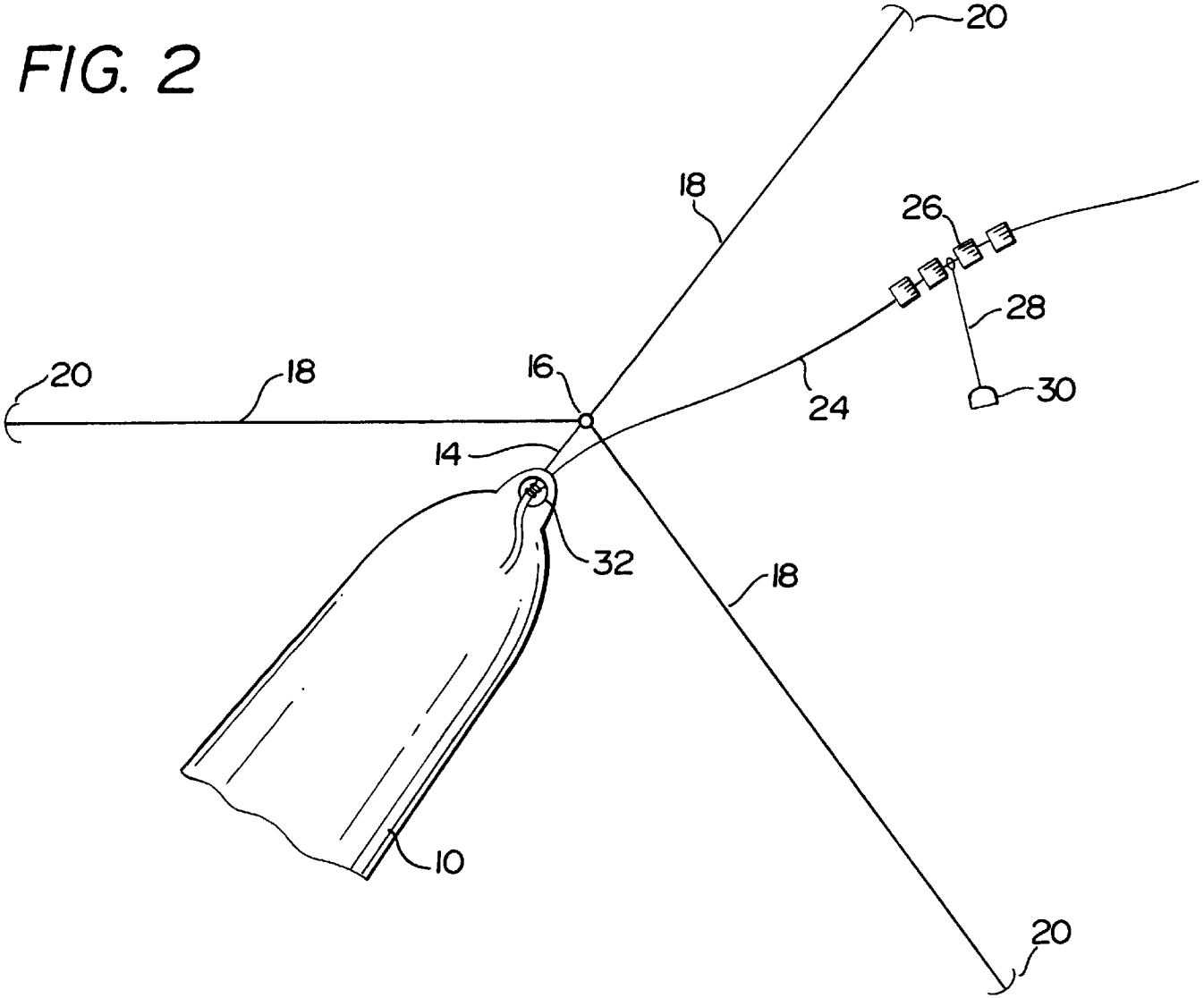
FIG. 2 is a top plan view of the mooring system of FIG. 1.

With reference to FIGS. 1 and 2, an FPSO vessel 10 is shown that is moored in position by a mooring system 12 constructed in accordance with the preferred embodiments of the present invention. The mooring system 12 includes a single anchor chain 14 which is affixed at a first end to a bow 15 of the FPSO 10 and at a second end to a chain connector 16. Three additional chains 18, which act as mooring legs, depend from the connector 16 in a catenary manner to three corresponding high holding power drag anchors 20 affixed to the seabed 22. The length of the anchor chain 14 is selected so that the connector 16 is positioned beneath the sea level a sufficient distance, e.g., 25 meters, so that the catenary mooring leg chains 18 do not interfere with the FPSO 10. As illustrated in FIG. 2, the mooring leg chains 18 are preferably spaced equidistant from one another at 120 degree angles to provide an even restoring force in all directions.

Figure 3:
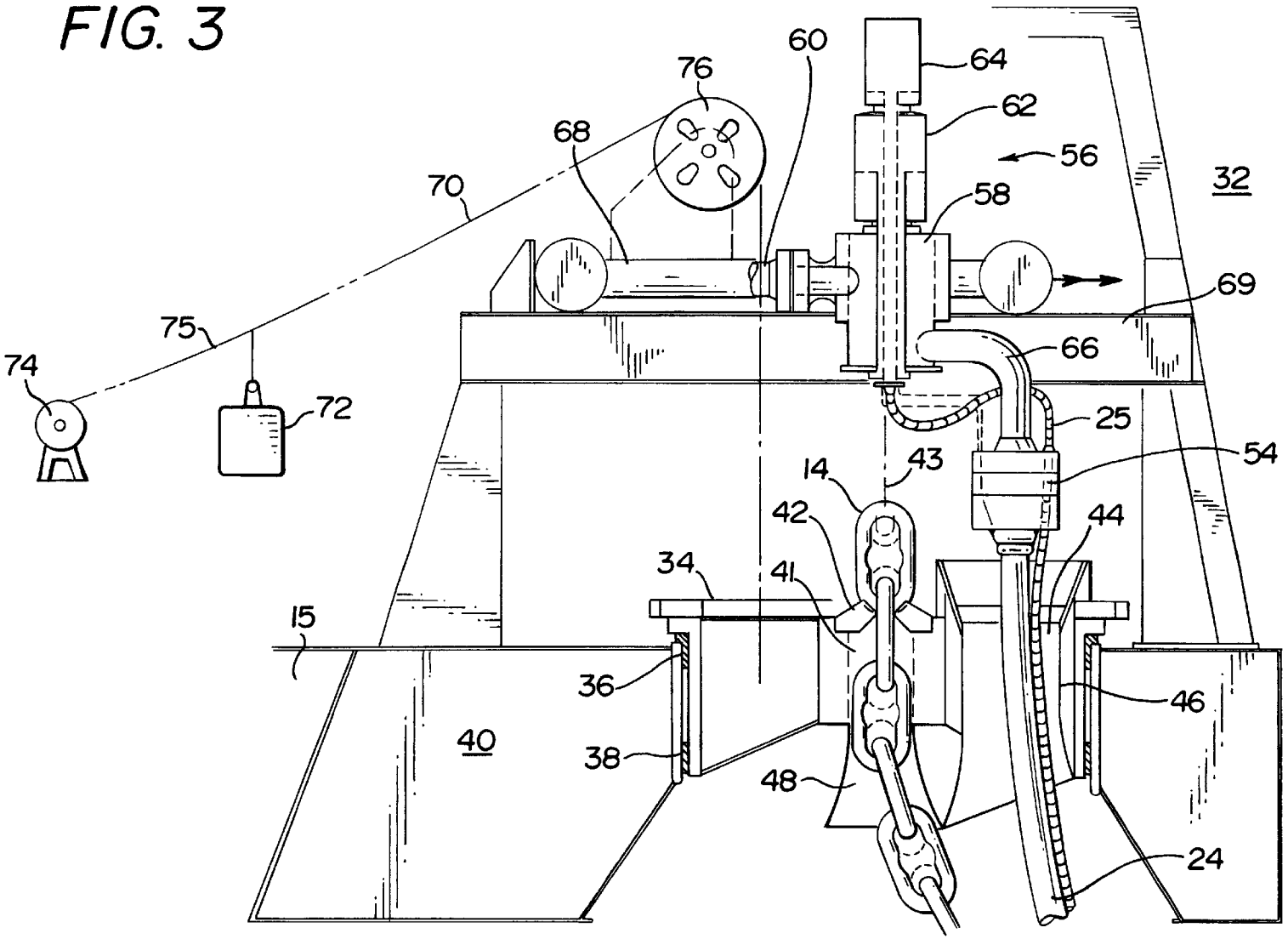
FIG. 3 is a sectional side elevation of a turret mooring employed in a first preferred embodiment.

A plurality of flexible risers 24 extend from the FPSO 10 down to the seabed 22, and to a subsea wellhead or offshore platform (not shown). The risers 24 are used for well effluent and injection of gas and water. Attached along the length of the risers 24 in a piggyback manner is an umbilical cord 25 as best illustrated in FIG.3 which houses electrical and hydraulic control lines for remote control of the wellheads or valves on the platform. To keep the risers 24 clear of the mooring chains 14 and 18, a plurality of buoyancy collars 26 are attached to the risers 24 at a position about midway between the seabed 22 and the surface. An additional mooring chain or line 28 is secured at one end to the risers 24 near the buoyancy collars 26, and at an opposite end to a clump weight 30 on the seabed 22. Together, these elements maintain the risers 24 in a vertically spaced relationsinp with respect to the mooring leg chains 18.

Both the anchor chain 14 and the risers 24 are removably secured to a rotatable turret mooring 32 attached to the bow of the FPSO 10. The turret mooring 32 is mechanically rotatable, as discussed in greater detail later, to enable the FPSO 10 to freely weathervane, in response to wind and wave currents, about the anchor chain 14 and the risers 24 without twisting them together.

Figure 4:
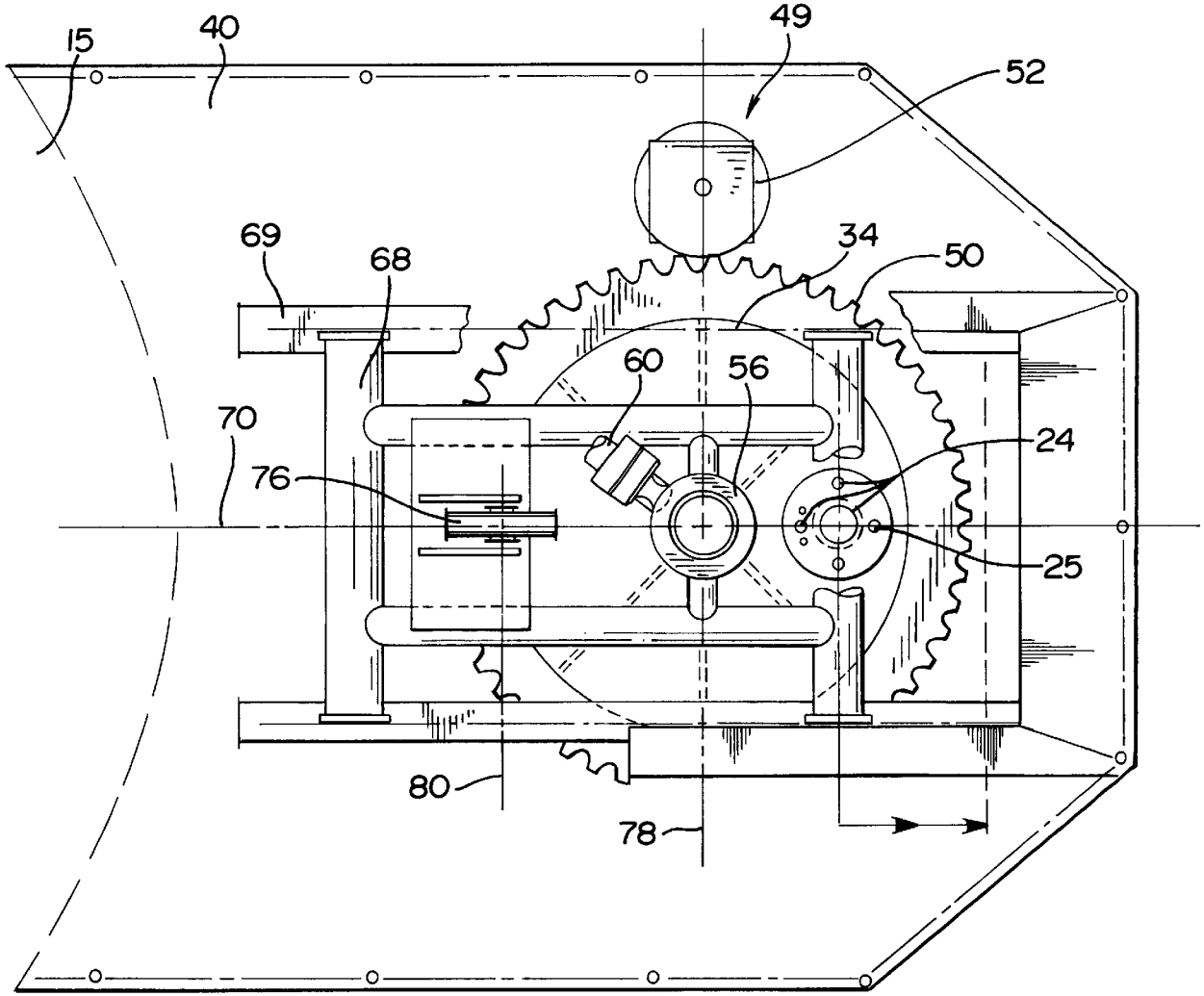
FIG. 4 is a partially sectioned top plan view of the turret mooring of FIG. 3.

FIGS. 3 and 4 illustrate the details of a first preferred embodiment of the turret mooring 32. The turret mooring 32 includes a circular mooring table 34 that is rotatably mounted by means of a pair of thrust bearings 36 and 38 in a fixed mooring platform 40 extending from the bow 15 of the FPSO 10. The thrust bearings 36 and 38 preferably comprise heavy duty journal bearings running on a stainless steel lined high strength shaft that provide very high resistance to wear and fatigue. Preferably, a non-conosive bearing material is employed so that sea spray will not affect the bearings 36 and 38. Alternatively, the bearings 36 and 38 can be roller type bearings that are protected from the seawater by means of a sealing arrangement.

Disposed in a centrally located aperture 41 in the mooring table 34 is a conventional chain stopper 42 for receiving the anchor chain 14, and holding it in position. The chain stopper 42 is hydraulically operated from a remote station on the FPSO 10 to allow the chain 14 to be selectively released and engaged. The vertical rotational axis 43 of the mooring table 41, about which the FPSO 10 weathervanes in response to wind and wave currents, is thus the central axis of the chain stopper 42. An offset aperture 44 is also disposed in the mooring table 34 next to the chain stopper 42 for reception of the risers 24 and piggyback umbilical cord 25. A riser guide 46 is disposed in the aperture 44 which extends beneath the mooring table 34. Similarly, a chain guide 48 extends beneath the table 34 from the central aperture 41. Together, the riser guide 46 and the chain guide 48 maintain a predetermined spacing between the anchor chain 14 and the risers 24 so that the contact with one another will be reduced as much as possible.

As illustrated in FIG. 4, a motor/gear drive 49 comprising a gear 50 attached to or integrally formed with the periphery of the mooring table 34, and a drive motor 52 is provided to rotate the mooring table 34 in response to pivoting of the FPSO 10 about the single anchor chain 14. it should be noted in this regard that use of the motor/gear drive 49 is necessary to overcome the frictional forces in the turret mooring 32 which would inhibit rotation of the mooring table 34, because the twisting of the chain 14 and the risers 24 cannot provide enough torque to turn the mooring table 34 by itself.

A conventional quick connect/disconnect (QC/DC) connection 54 is provided for removably connecting the risers 24 and umbilical 25 to a swivel stack 56. The swivel stack 56 includes a plurality of swivel joints for rotatably connecting the risers 24 and lines in the umbilical 25 to associated elements on the FPSO 10. These include a swivel 58 for connecting the risers 24 to the FPSO's piping 60; a multiple path hydraulic swivel 62 for connecting the hydraulic lines in the umbilical 25 to corresponding lines (not shown) on the FPSO 10; and, an electrical swivel 64 for connecting the electrical lines in the umbilical 25 to corresponding lines (also not shown) on the FPSO 10.

An elbow or L-shaped section of piping 66 is disposed between the QC/DC connection 54 and the swivel stack 56 so that the swivel stack 56 is positioned directly above the chain stopper 42 along the vertical rotational axis 43 of the mooring table 34 about which the FPSO 10 rotates during operation. To provide ease and convenience in connection/disconnection operations, the swivel stack 56 is disposed on a movable frame 68 winch can be moved laterally along a portion 69 of the mooring platform 40 as indicated by the arrows in FIGS. 3 and 4. The upper end of the anchor chain 14 is connected to a pull-in line 70, to which is attached, a marker buoy 72. In FIG. 3, the pull-in line 70 and marker buoy 72 are shown on the FPSO 10 in which the pull-in line 70 has been reeled-in by a winch 74. However, before the FPSO 10 is connected to the anchor chain 14, the marker buoy 72 is floating on the water's surface to facilitate identification of the mooring chain's and risers' positions, and enable easy connection of a winch line 75 thereto for reeling the anchor chain 14 into secure engagement with the chain stopper 42.

Also mounted on the frame 68, is a pulley sheave 76 for the pull-in line 70. Thus, in a connect operation, for example, the frame 68 is first slid forward to position the pulley sheave 76 in line with the chain stopper 42 as indicated by the first reference line 78 in FIG. 4. The winch line is then unwound through the chain stopper 42 and into the water where it is hooked onto the pull-in line 70. The winch 74 is then reversed to pull the anchor chain 14 through the chain stopper 42, and bring the marker buoy 72 on board the FPSO 10. The marker buoy 72 is also connected to the oil risers 24 so that they too are raised out of the water into a position beneath the riser guide 46. After the anchor chain 14 is secured to the chain stopper 42, the frame 68 is slid back to its operational position as illustrated in FIG. 4 with the pulley sheave 76 lined up with the second reference line 80, and the swivel stack's half of the QC/DC connection 54 positioned directly above the riser guide 46. The risers 24 and umbilical 25 are then raised through the riser guide 46, and the halves of the QC/DC connection 54 are mated to one another, thereby completing the mooring connection operation. To disconnect the FPSO 10 from the mooring system 12, the foregoing steps are reversed.

Figure 5:
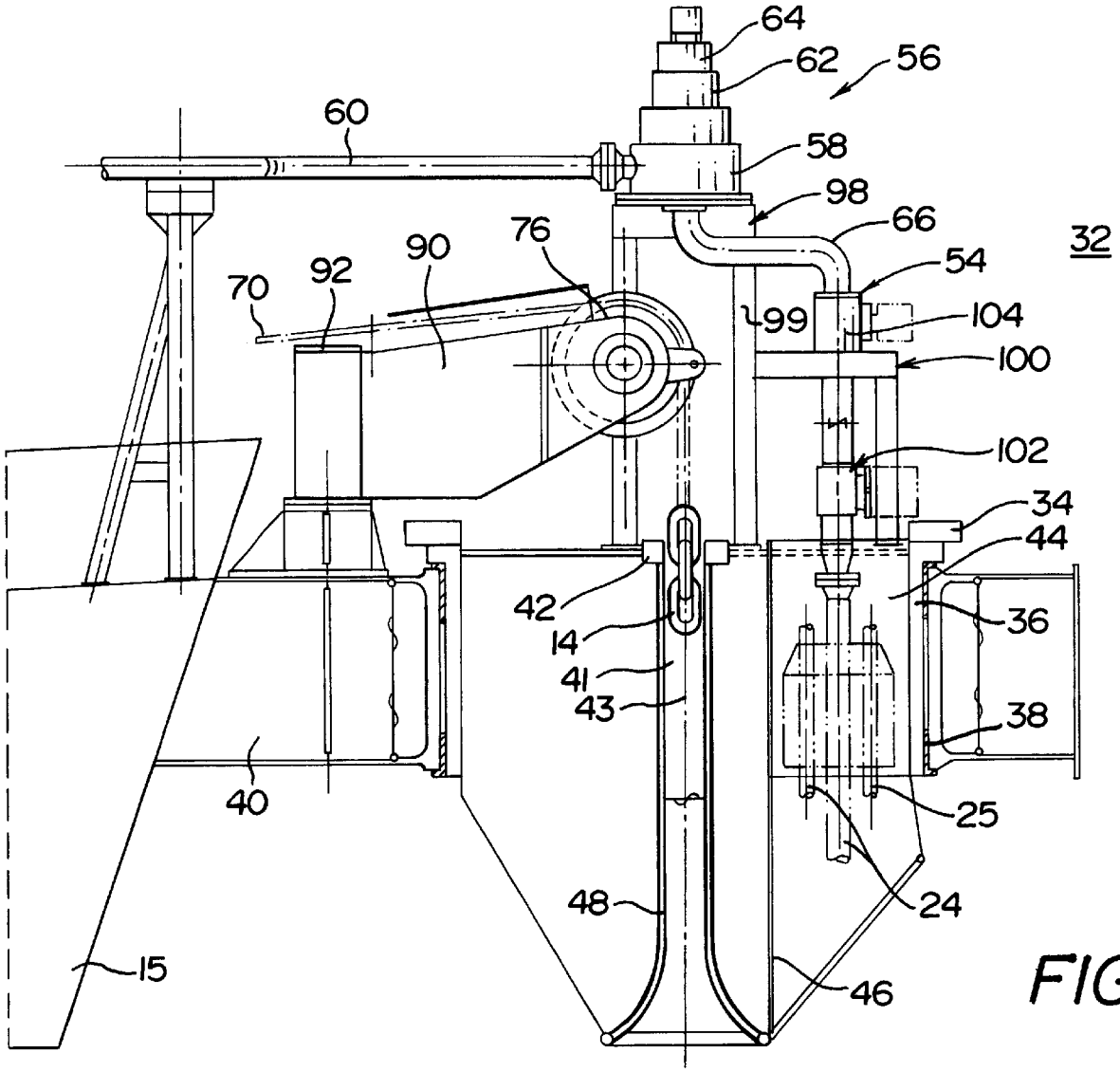
FIG. 5. is a sectional side elevation of a turret mooring employed in a second preferred embodiment.
Figure 6:
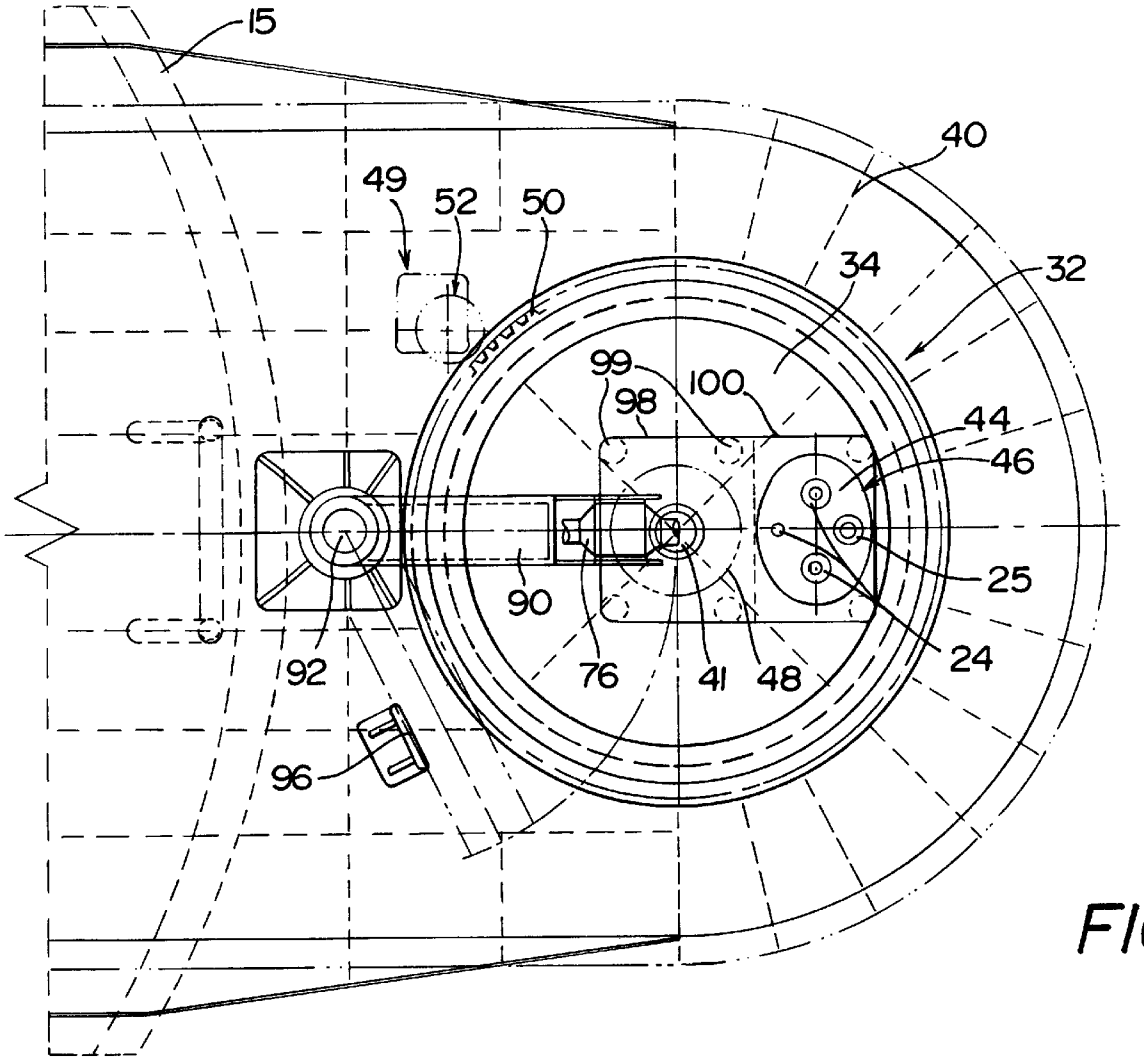
FIG. 6 is a partially sectioned top plan view of the turret mooring of FIG. 5.

FIGS. 5 and 6 illustrate a second preferred embodiment of the turret mooring 32. This embodiment includes many of the same elements of the first embodiment, and the same numbers are therefore employed to designate like elements. Tins embodiment differs from the first embodiment in the following manner. A different design pulley sheave frame 90 is employed that is pivotally mounted at one end on a large pivot pin 92 attached to the mooring platform 40. This mounting arrangement permits the pulley sheave frame 90 to rotate about a vertical axis as illustrated in FIG. 6 between first and second positions. In the first position, the pulley sheave 76 is directly over the chain stopper as in the first embodiment to allow the pull-in line 70 and anchor chain 14 to be retrieved, while in the second position, the sheave frame 90 is rotated clear of the mooring table 34, and abuts a sheave frame stopper 96 as illustrated by the dashed lines in FIG. 6.

Another difference in the second embodiment is the provision of a fixed support frame 98 for the swivel stack 56 winch is attached directly to the mooring table 40, and thus rotates therewith. After the anchor chain 14 is reeled into engagement with the chain stopper 42, the pulley sheave frame 90 must therefore be rotated to its second position in contact with the sheave frame stopper 96 to allow the support frame 98 to rotate with the mooring table 34 without interfering with a plurality of support legs 99 for the support frame 98. The support frame 98 also includes a section 100 for supporting the QCDC 54. First and second valves 102 and 104 are also shown positioned between the QCDC 54 and the risers 24 for shutting off the fluid flow when the risers 24 are separated from the elbow pipe 66.

Once the FPSO 10 is secured to the anchor chain 14, the environmental forces on the vessel are resisted by the catenary mooring leg chains 18 and their corresponding drag anchors 20. The moored vessel can freely weathervane about the vertical axis 43 of the single anchor chain 14 in response to changing wind and current directions. The rotating mooring table 34 is automatically rotated by the motor/gear drive 49 to maintain the table's orientation relative to the seabed. At the same time, the swivel stack 56 allows the risers 24 to rotate with the mooring table 34.

Through use of the single anchor chain 14 and the turret mooring that accommodates connection both to the anchor chain 14 and the users 24, the present invention therefore results in a cost effective mooring arrangement for tanker vessels winch can be easily adapted to new locations and water depths, and includes components that facilitate quick and easy connection/disconnection of the system components to and from the tanker vessel.

Although the present invention has been disclosed in terms of a pair of preferred embodiments, it will be understood that modifications and variations could be made thereto without departing from the scope of the invention as defined in the following claims.

I claim:

1. A mooring system for a vessel comprising:

a) a mooring table rotatably attached to a vessel to be moored, said mooring table including:
   1) a first, centrally located aperture having a chain stopper positioned therein for receiving and securing an anchor chain; and
   2) a second, offset aperture for receiving at least a first fluid carrying riser;

b) a single anchor chain passing through said first, centrally located aperture and secured by said chain stopper;

c) a submerged chain connector connected to a lower end of said anchor chain;

d) first, second and third submerged catenary mooring leg chains each having a lower end secured to a sea bed and an upper end connected to said chain connector;

e) a fluid carrying swivel joint disposed on said vessel;

f) a quick connect/disconnect coupling attached to said fluid swivel joint; and g) at least a first fluid carrying riser passing through said second, offset aperture and having an upper end connected to said quick connect/disconnect coupling.

2. The mooring system of claim 1, wherein said swivel joint is positioned directly above said first, centrally located aperture in said mooring table, said first aperture defining a vertical axis about which said vessel and said swivel joint can rotate.

3. The mooring system of claim 2, wherein said swivel joint is mounted on a frame attached to said vessel, and said system further includes a pulley sheave mounted on said frame for guiding a pull-in line for said anchor chain, said frame being movable to first and second positions, said first position where said pull-in line is positioned directly above said first, centrally located aperture in said mooring table to facilitate pulling of said anchor chain through said chain stopper to anchor said vessel, and a said second position where said swivel joint is positioned directly above said centrally located aperture.

4. The mooring system of claim 3, wherein said swivel joint is connected to said quick connect/disconnect coupling with an elbow pipe that is lined up with said quick connect/disconnect coupling when said frame is moved to said second position.

5. The mooring system of claim 4, further including a hydraulic swivel joint and an electrical swivel joint for hydraulic and electric control lines positioned in a stacked manner on top of said fluid swivel joint.

6. The mooring system of claim 2, wherein said swivel joint is mounted on a support frame attached to said mooring table, and said system further includes a pulley sheave for guiding a pull-in line for said anchor chain, said pulley sheave being disposed on a frame that is pivotally mounted on said vessel, and rotatably movable about a vertical axis to first and second positions, said first position where said pull-in line is positioned by said pulley sheave directly above said first, centrally located aperture in said mooring table to facilitate pulling of said anchor chain through said chain stopper to anchor said vessel, and said second position where said sheave frame is rotated clear of said swivel joint support to permit free rotation of said support with said mooring table.

7. The mooring system of claim 6, wherein said swivel joint is connected to said quick connect/disconnect coupling with an elbow pipe.

8. The mooring system of claim 7, further including a hydraulic swivel joint and an electrical swivel joint for hydraulic and electric control lines positioned in a stacked manner on top of said fluid swivel joint.

9. The mooring system of claim 1, wherein said chain connector is positioned approximately 25 meters beneath the water surface.

10. The mooring system of claim 1, further including first and second guide tubes disposed on said mooring table to prevent said anchor chain and said riser from interfering with one another, said tubes depending beneath said table below said first and second apertures, respectively.

11. The mooring system of claim 1, further including buoyancy elements and a mooring line attached at a submerged portion of said riser to prevent said riser from interfering with said catenary mooring leg chains.

12. The mooring system of claim 1, wherein said catenary mooring leg chains are equally spaced at 120 degree angles with respect to one another.

13. The mooring system of claim 1, further comprising means for rotating said mooring table relative to said vessel.

14. A mooring system for a vessel comprising:

a) a mooring table rotatably attached to a vessel to be moored, said mooring table including:

1) a first, centrally located aperture having a chain stopper positioned therein for receiving and securing an anchor chain; and 2) a second, offset aperture for receiving at least a first fluid carrying riser;

b) a single anchor chain passing through said first, centrally located aperture and secured by said chain stopper;

c) a submerged chain connector connected to a lower end of said anchor chain;

d) first, second and third submerged catenary mooring leg chains each having a lower end secured to a sea bed and an upper end connected to said chain connector, said mooring leg chains being equally spaced from one another at 120° angles;

e) a movable frame attached to said vessel;

f) a pulley sheave mounted on said frame for guiding said anchor chain through said chain stopper and onto said vessel;

g) a fluid carrying swivel joint mounted on said frame;

h) a quick connect/disconnect coupling attached to said fluid swivel joint with an elbow pipe; and i) at least a first fluid carrying riser passing through said second, offset aperture and having an upper end, wherein said frame is movable to a first position where said pulley sheave is positioned above said chain stopper to facilitate pulling in of said anchor chain, and is movable to a second position in which said quick connect/disconnect coupling can be connected to said upper end of said fluid carrying riser, and said fluid swivel joint is directly above said first, centrally located aperture in said mooring table, whereby said fluid swivel joint and said vessel can rotate about the same vertical axis defined by said first aperture.

15. A method for mooring a fluid carrying vessel comprising the steps of:

a) providing a submerged mooring arrangement comprising first, second and third catenary mooring leg chains each having a lower end secured to a seabed and an upper end connected to a chain connector, said arrangement further including a single anchor chain secured at a bottom end to said chain connector and having a free end to be secured to a vessel to be moored;

b) providing at least one submerged fluid carrying riser having a free end to be secured to a fluid carrying line on a vessel to be moored;

c) providing a mooring table rotatably attached to said vessel to be moored, said mooring table including:

1) a first, centrally located aperture having a chain stopper positioned therein for receiving and securing said anchor chain; and 2) a second, offset aperture for receiving said at least first fluid carrying riser;

d) providing a fluid carrying swivel joint mounted on said vessel;

e) providing a pulley sheave mounted on said vessel for guiding said anchor chain onto said vessel;

f) positioning said pulley sheave in a first position where said pulley sheave is positioned above said chain stopper;

g) attaching a pull-in line to said free end of said anchor chain;

h) reeling in said pull-in line and said anchor chain through said chain stopper and over said pulley sheave to secure said vessel to said anchor chain;

i) positioning a quick connect/disconnect coupling connected to said fluid swivel joint above said second, offset aperture; and j) pulling said free end of said fluid riser through said offset aperture in said mooring table, and attaching said free end to said quick connect/disconnect coupling.

16. The method of claim 15, wherein said swivel joint and said pulley sheave are mounted on a frame that is movably mounted on said vessel, and said steps of positioning said pulley sheave and said quick connect/disconnect coupling further comprise:

1) positioning said movable frame in a first position where said pulley sheave is positioned above said chain stopper; and 2) positioning said movable frame in a second position where said quick connect/disconnect coupling is positioned above said second, offset aperture.

17. The method of claim 15, wherein said first, second and third mooring leg chains are secured to said seabed at equally spaced, 120° angles with respect to one another.

18. The method of claim 15, further comprising the steps of attaching at least one buoyancy element and a mooring line to said riser to prevent said riser from interfering with said mooring leg chains.

19. The method of claim 15, wherein said swivel joint is mounted on a swivel joint support frame attached to said mooring table, said pulley sheave is disposed on a pulley sheave frame that is pivotally mounted on said vessel and is rotatably movable about a vertical axis between said first position and a second position where said sheave frame is rotated clear of said swivel joint support to permit free rotation of said swivel joint support with said mooring table; and said method further comprises the step of rotating said pulley sheave frame to said second position after said anchor chain is secured to said chain stopper.

* * * * *